US006041456A

United States Patent [19]

Pharr

[11] Patent Number: 6,041,456

[45] Date of Patent: Mar. 28, 2000

[54] STRUCTURE FOR A FITTED BEDSHEET

[76] Inventor: Malcolm L. Pharr, P.O. Box 366, Wilmington, N.C. 28401

[21] Appl. No.: 09/128,910

[22] Filed: Aug. 4, 1998

[51] Int. Cl.[7] ..... A47G 9/04

[52] U.S. Cl. ..... 5/497

[58] Field of Search ..... 5/482, 485, 494, 5/497, 499

[56] References Cited

U.S. PATENT DOCUMENTS

| | | | |
|---|---|---|---|
| 2,679,056 | 5/1954 | Simpson | 5/485 |
| 2,695,414 | 11/1954 | Ford et al. | 5/485 |
| 2,788,532 | 4/1957 | Christley | 5/497 |
| 3,868,735 | 3/1975 | Ross . | |
| 4,308,626 | 1/1982 | Weiss . | |
| 5,042,098 | 8/1991 | Stultz . | |
| 5,165,128 | 11/1992 | Honig . | |
| 5,189,744 | 3/1993 | Roberts . | |
| 5,465,440 | 11/1995 | Heptner . | |

FOREIGN PATENT DOCUMENTS

| | | | |
|---|---|---|---|
| 2694177 | 2/1994 | France | 5/497 |
| 2301182 | 7/1974 | Germany | 5/497 |

*Primary Examiner*—Terry Lee Melius
*Assistant Examiner*—James M Hewitt
*Attorney, Agent, or Firm*—Rhodes & Manson, PLLC

[57] ABSTRACT

A fitted top sheet adapted for use on a mattress having a given width, a given length and a given thickness, the sheet having a width greater then the given mattress width, parallel side edges and a bottom edge, the sheet including an upper portion and a lower portion folded beneath the upper portion, the edges of the lower portion being non-elastically sewn to the side edges of the upper portion to form a pocket, and the bottom edge of the sheet being elastically gathered to a width approximately equal to the given mattress width when in an unstretched condition.

17 Claims, 3 Drawing Sheets

STRUCTURE FOR A FITTED BEDSHEET

BACKGROUND OF THE INVENTION

1. Field of the Invention

The present invention is directed to a novel and improved bedcovering, and in particular, a top sheet structure having a pocket at the end to fit over the end of a mattress, together with a billowing portion of the material of the structure at each corner to provide a space of a loose part of the top sheet over a person's feet under the sheet.

2. Description of the Prior Art

Fitted top sheets on mattresses have been known and described in the prior art. Such a fitted top sheet aids in the maintenance of the top sheet in position on a mattress. The use of these fitted top sheets on mattresses helps in making beds and retaining the sheet in position on the mattress.

A general difficulty with such fitted top sheets, however, resides both in application to the mattress and in the ability of a person lying under the top sheet to move his/her feet around because of the tight fit of the bottom of the sheet on the mattress. The fitted top sheet being under tension on the mattress exacerbates this tight fit. Further, during sleep, attempts to move the sleepers feet around without pulling the top sheet from the mattress are rendered very difficult.

A prior art construction to aid in the application of a top sheet to a mattress is shown in the U.S. Pat. No. 5,189,744. Here a top sheet is attached to a mattress by way of an end fitting of the top sheet having an expandable end pocket that fits over the end of the mattress. The end pocket is constructed by having expandable connections at the seams between the edges of the end pocket and also across the entire width of the end of the top sheet. In this prior construction elastic material is placed into the seam between the sides of the end pocket connection to itself. Also the primary feature of such elastic material is that it may be placed entirely along the edge of the end of the top sheet.

A difficulty with this prior construction occurs in the elastic material being under tension after being placed on the mattress so that the top sheet is formed tightly over the mattress. Such maintaining of the sheet tightly over the mattress prevents a person lying under the top sheet to freely and easily move his/her feet around.

Another prior arrangement of top sheets for beds may be seen in U.S. Pat. No. 5,165,128. This prior patent shows a fitted top sheet having a rectangular piece of fabric being cut away at the two bottom corners. Each of these corners is cut away in two square notches with the outer sides being sewn together to form a pocket to be fitted on the corners of a mattress. A band of stretchable material is sewn to the sides of the remaining square notches and to the edge end of the top sheet. This band of stretchable material holds the pocket onto the end of the mattress, as well as the corners. Thereafter, the top sheet construction is stated to provide foot room between the top sheet and a bottom sheet previously fitted onto the mattress because the band of stretchable material can be further expanded.

The patent provides ease in making a bed having a fitted top sheet. However, the top sheet is fit tightly over the mattress with further stretching of the stretchable material being necessary to place feet comfortably beneath the top sheet. Moreover, a complicated technique is needed to form and provide the pocket before it is installed onto the bed or mattress.

Also the prior art seen in U.S. Pat. No. 5,465,440 shows a similar construction to the previously noted prior art in that a top sheet is formed with a box-like structure at one end to be fitted over the end edge of a mattress. This provides a partially fitted top sheet to not only enable making up of the bed initially, but also to help make the bed with the same sheets after their use. The feature of this patent enables neat and snug fitting of the top sheet to the bed with the further allowance of a sufficient overhang to provide both foot and body room under the top sheet. An elastic material is secured to extend entirely along the bottom portion of the top sheet between the side portions of the sheet. This elastic material is attached in an outstretched condition to cause the ends of the side portions of the sheet to be drawn toward one another when fitted onto a mattress, thereby causing a tight fit of the top sheet at the end portions of the bed.

Again, while ease in making the bed is achieved, a tight fit to the top sheet over the feet of a person at the end of the bed may occur. Also the technique of forming this structure becomes complicated and difficult to form.

The U.S. Pat. No. 3,868,735 provides a top sheet having arcuate cut-outs at the foot end of the bed. These cut-outs enable a pocket to be formed along the bottom of the top sheet with side flaps formed at the corners with elastic strips inserted along the arcuate cut-off portions. This structure enables the top sheet to fit snugly over the foot of the bed so as to not come loose. The same difficulty as in the previous prior art of providing a tight top sheet at the foot end of the mattress and having a complicated formation of such structure occurs with this reference.

In the prior art references of U.S. Pat. Nos. 5,042,098 and 4,308,626 attempts were made to provide space under the top sheet for a person's feet. Thus, in U.S. Pat. No. 5,042,098 a pleat is provided across the foot end of a top sheet. The pleat is formed by folding a middle portion of the foot end over between cut-out corners to provide an overlapping relationship and securing the cut edges of each corner together. Elastic material is fixed along the edge from a seam line at the pleat from one side around to the other side of the sheet to fix the corners of the sheet over the mattress. The pleat then provides room for the feet below the top sheet. However, this space is formed between the elasticized fittings of the corners, which maintain a taut fitting on the sheet.

U.S. Pat. No. 4,308,626 provides an arrangement of a fitted top sheet having provisions for an expansion space. This bed sheet has a fitted end placed over the end edge of the mattress, and two sewn portions at each end form a fitted sheet with an upright part for the feet of a person. The placing of the sheet onto the mattress is made by using a maximum mattress-to-cover distance that is greater than the thickness of the mattress to provide a space above the mattress. This space is further formed by cuts into the sheet at the corners and sides of the sheet which cuts are sewn together.

While space is provided for the feet under the top sheet in this prior arrangement, the maintenance of the top sheet in place on the mattress can be disturbed since there is no feature for holding the sheet in place on the mattress. No elastic or elasticized material is provided to prevent pulling of the sheet from the mattress by someone in the bed who moves around during sleep.

In all of the prior art using elasticized strips for holding the top sheet onto the mattress, the features of the present invention of providing a bedcovering on the mattress without any tension from elastic material does not exist in the prior art. Further, the additional feature of the present invention of providing corners of the fitted bedcovering with sufficient material to provide space under the covering for a person's feet is also not found in the prior art. It is the purpose of the present invention to provide these features in a bedcovering or top sheet structure.

SUMMARY OF THE INVENTION

The present invention relates to a bedcovering, such as a top sheet, blanket, quilt, or the like, and in particular to a bedcovering that is fitted to the lower end of a mattress to maintain the bedcovering in its proper location, while still allowing sufficient space near the lower end or foot of the bed for comfortable positioning and movement of the user's feet. Although the construction of the bedcovering will be described herein with particular reference to a top sheet, it will be understood that the construction is also applicable to other kinds of bedcovering positioned over a person sleeping on a bed.

The fitted top sheet of the invention may be fitted onto different sized mattresses, such as the sizes known in the trade as twin-size, full-size, queen-size, and king-size. The dimensions of the top sheet in each instance will be relative to the dimensions of the mattress onto which the top sheet is fitted. That is, the sheet may be a conventional sheet of a standard size for the mattress on which it is to be fitted. For example, a standard queen-sized flat top sheet can be made into a fitted queensize top sheet in accordance with the present invention.

That is, a mattress of any given size will have a given length, a given width and a given thickness. The sheet applicable to a particular mattress will be constructed from a generally rectangular sheet of textile material having a width at least equal to the width of the mattress, and preferably the mattress width plus twice the thickness of the mattress. The sheet length should be greater than the mattress length, and preferably equal to the length of the mattress, plus about twice the thickness of the mattress in order to allow for the lower end of the sheet to be folded beneath the mattress.

The fitted top sheet of the invention is constructed from a rectangular sheet of these dimensions by folding under a portion of the sheet to form an upper sheet portion and a bottom sheet portion at the lower end of the sheet, and sewing the edges of the bottom folded under portion to adjacent edges of the top portion to form a pocket that can be inserted around the lower end of the mattress. In order to maintain the sheet on the mattress, the bottom edge of the sheet, i.e., the edge of the folded under portion, is gathered to a length substantially equal to the width of the mattress when in an unstretched condition, thereby applying sufficient contraction to the "neck" of the pocket, while still allowing room for the person's feet.

More specifically, the fitted top sheet for use on a mattress having a given width, a given length, and a given thickness, is comprised of the generally rectangular sheet of textile material that has a top edge, parallel side edges, and a bottom edge. The sheet has a width approximately equal to the given mattress width, plus about twice the given mattress thickness, and a length approximately equal to the given mattress length, plus about twice the given mattress thickness.

The top sheet is folded to form a top portion and a folded under bottom portion, with adjacent edges of the top and bottom portions being sewn together in an unelasticized manner, i.e., without elasticity or gathering, to form a pocket to receive the lower end of the mattress. Elastic is sewn along the bottom edge of the sheet to gather the edge, thereby reducing its length to a length equal to the width of the given mattress when in an unstretched state. Preferably, end sections of the sheet are gathered adjacent each end of the bottom edge, while the center section of the bottom edge is left ungathered.

For example, approximately one-third of the sheet bottom edge can be gathered at each side of the bottom edge, while the center one-half of the bottom edge is left ungathered. It is important to the proper functioning of the invention, however, that the total unrelaxed, i.e., unstretched, width of the sheet bottom edge is substantially equal to the width of the mattress being covered. With this unstretched width, the sheet is held securely onto the mattress while there is still comfortable space for the user's feet.

This comfort results from the fact that the ends of the pocket form billowing corners at each lower side corner of the mattress. The additional fabric in these billowing corners can thus be used to provide space for the user's feet. At the same time, the combination of the unelasticized or ungathered edge seams joining the sides of the upper and lower sheet portions, in combination with the length of the elasticized lower edge, holds the sheet securely to the bottom of the mattress.

Importantly, the elastic is not under tension in a rest position after installation on the bed. The forming of the elastic material or strip into the fitted sheet or the like without tension avoids any problems that may occur by a pulling up of the sheets on the mattress at the corners of the bed. In addition the avoidance of tension reduces the tightness of the sheet or the like under the feet of any person lying in the bed under the top sheet.

The elastic material only needs to be installed within and along the bottom edge of the top sheet at the end of the sheet. This is the bottom edge of the sheet structure that is secured to the side edges during formation of the pocket. An elasticized strip of the invention is disposed from this connection at each side toward the middle of the bottom edge. It does not extend the full length of the bottom edge, but only to a distance from the sewn edges, leaving about one-half of the bottom edge free of elastic material. The only real criteria is that the elastic material provides sufficient expansion of the bottom edge so the corners of the top sheet may be extended over the corners of the mattress and bottom sheet during installation on the bed, and thereafter exert no tension on the mattress.

Further, the top sheet or the like is constructed to include billowing corners of sheet material at the bottom corners of the bed. Such billowing corners of the sheet provide additional room under the sheet at the foot area of a person lying in the bed. The billowing corners reduce undue binding of the person's feet as he/she moves around in bed during sleep. While these billowing corners can hang over the end or bottom corners of the bed, they also can be extended outwardly or upwardly from the bed corners for at least about eleven inches or so. The size and extent of such corners depends on the thickness of the mattress, but are always sufficient to enable the top sheet to be raised by a person's feet to a distance sufficient to accommodate the feet.

These billowing corners are formed from the original sheet material. The corners involve the folded-over portion of the sheet being sewn together at the adjacent side edges. This folded-over portion includes the thickness of the mattress on which the top sheet structure is installed plus enough sheet material to form the pocket enclosing the end of the mattress. Thereafter, elastic material is attached along the bottom edge to extend from the seam of the of the billowing corners to along the bottom edge of the sheet for a distance sufficient to enable expansion of each bottom corner of the sheet to be inserted onto the mattress. This distance is preferably about one-third of the distance from each side of the sheet. The sewing or attaching of the elastic material along the bottom edge gathers the sheet material from the sewn edges to cause the sheet to billow at the corners of the folded-over portion. When the sheet is installed onto a mattress, the billowing corners then hang off of the corner of the mattress.

These features of the present invention will become apparent to those of ordinary skill in the art after a reading of the following description of the invention

BRIEF DESCRIPTION OF THE DRAWING FIGURES

DETAILED DESCRIPTION OF THE INVENTION

In the following description, terms such as horizontal, vertical, above, below, top, bottom, side, lower, upper and the like are used solely for the purpose of clarity in illustrating and describing the invention, and should not be taken as words of limitation.

Figure 1:
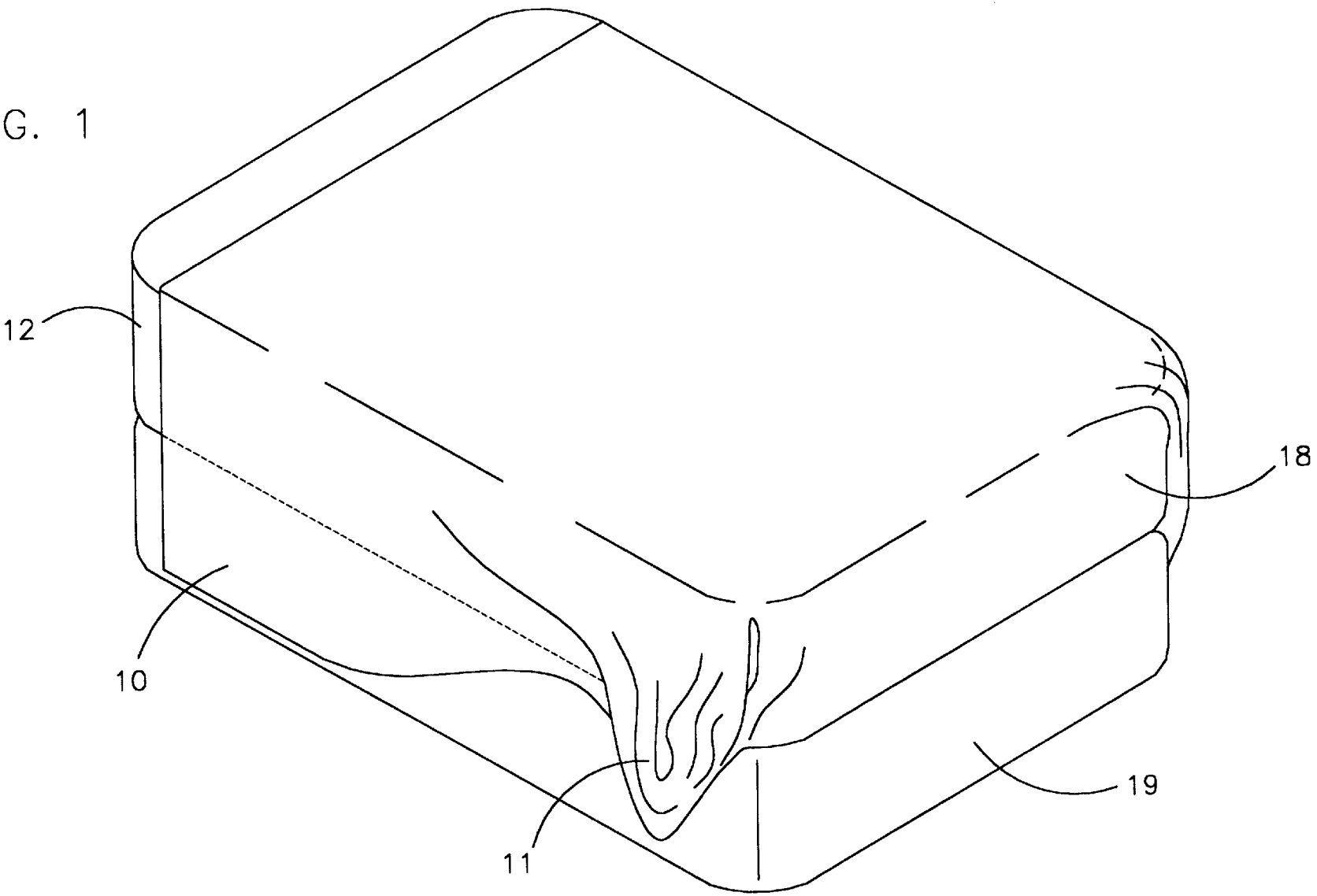
FIG. 1 is a perspective view, taken from above, of a fitted top sheet on a mattress and supporting box springs.

A finished installation of the top sheet 10, or the like, is shown in FIG. 1 on a mattress 12, which is installed on a bed having a box spring 19. This structure of the top sheet 10 has two billowing corners 11 that are each fitted at each bottom corner of the mattress 12. Elastic material 14 disposed along an edge 15 of the top sheet pulls the side edges 17 of the sheet inwardly toward the mattress 12, as may be seen from beneath in FIG. 2.

The billowing flaps or corners 11 are part of the top sheet material that has been folded over so that the bottom edge 15 is located a short distance from the end of the mattress 12. This provides a new end 18 of the top sheet that will be at the bottom end of the mattress. The short distance is determined by the thickness of the mattress plus a sufficient amount so that a person's feet under the installed top sheet can easily move around without pulling the top sheet material from the mattress. Although various mattresses have different thicknesses, it has been found that the short distance may be formed to around 11 to 12 inches in order to both provide the billowing corners of the invention and leave enough space under the sheet for a person's feet. This short distance also enables formation of the pocket for the top sheet structure to enclose the end of the mattress.

Figure 2:
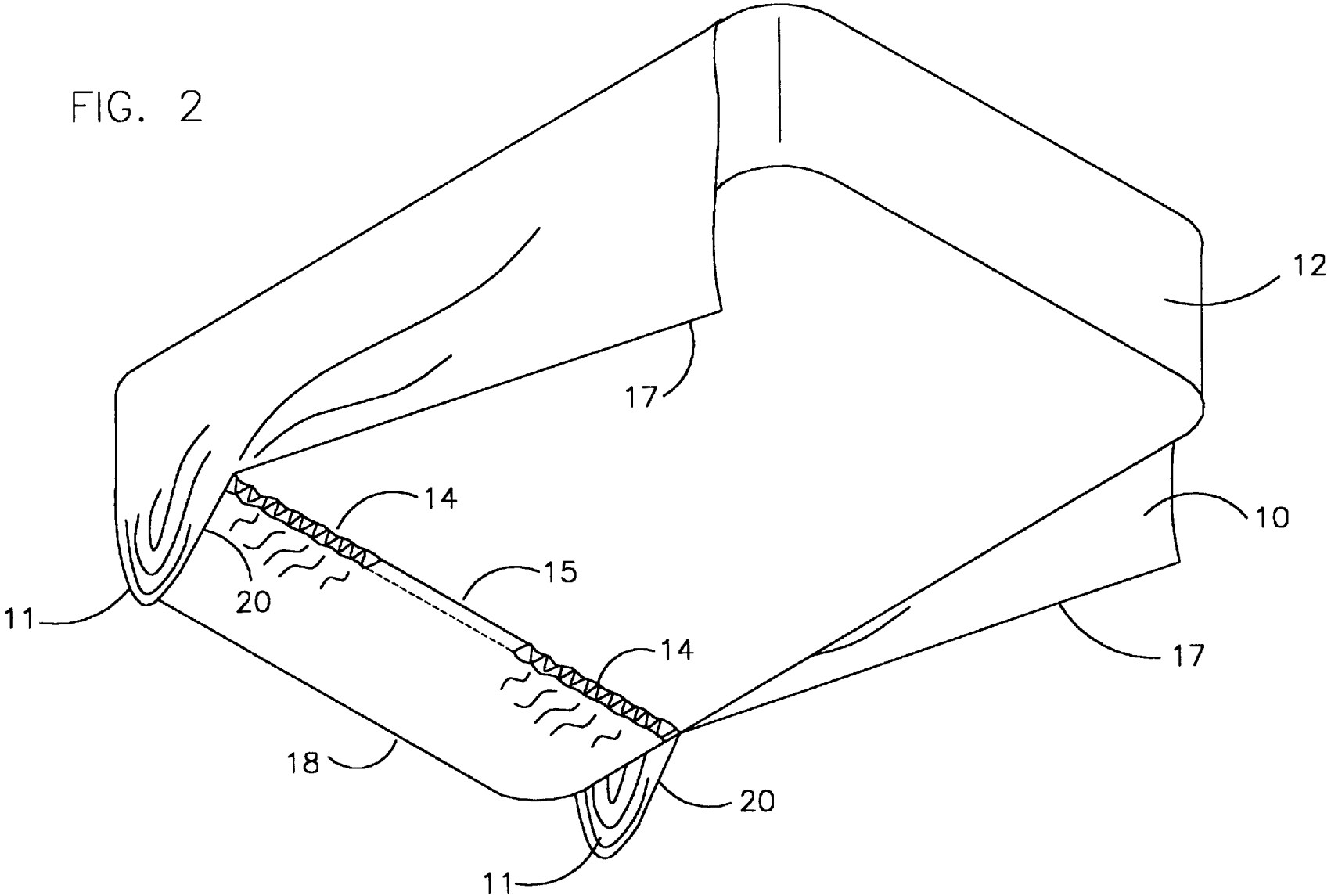
FIG. 2 is a perspective view, taken from below, of a fitted top sheet on a mattress.
Figure 3:
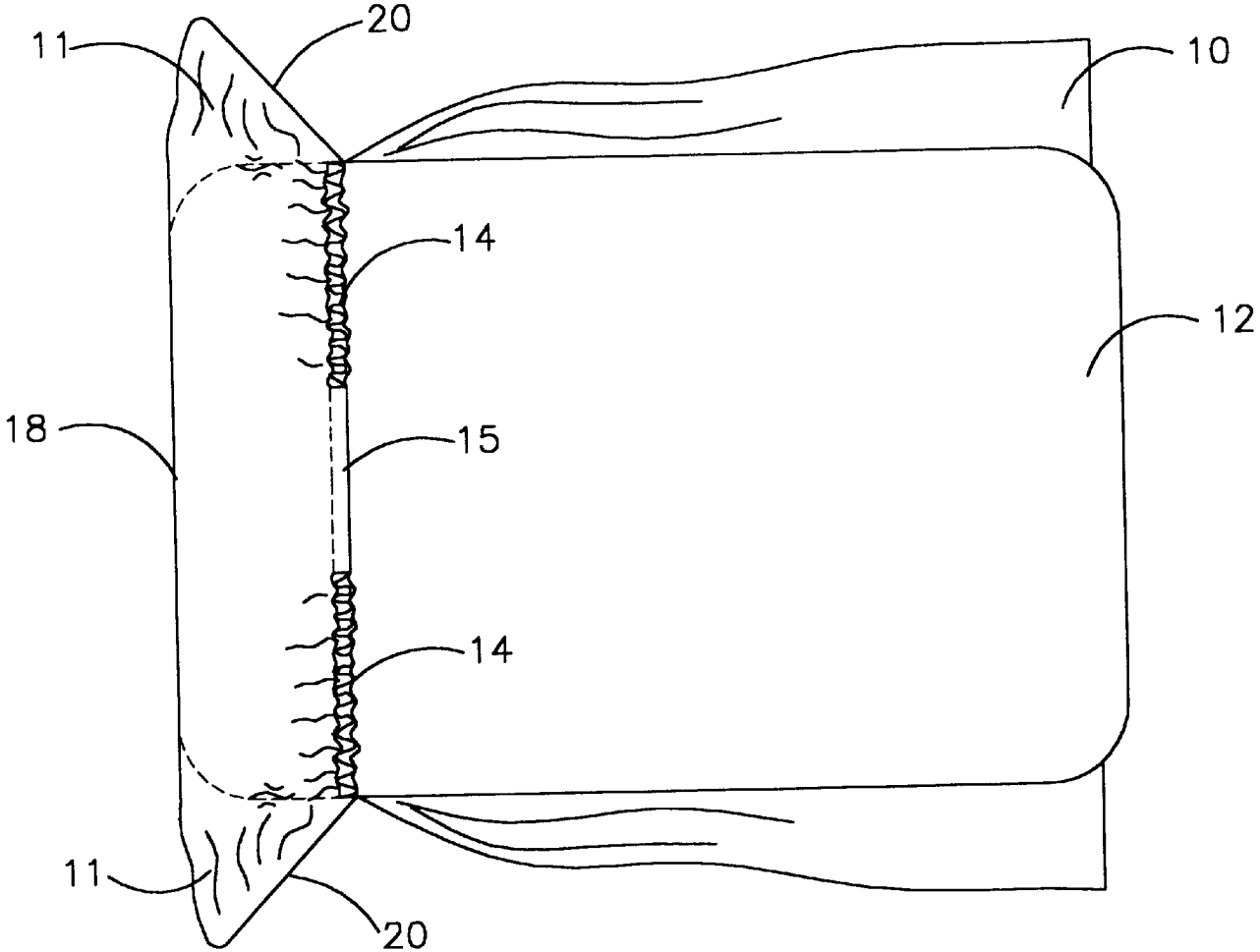
FIG. 3 is a plan view of the bottom of a fitted top sheet on a mattress.

From FIGS. 2 and 3, it can be seen that the elastic material 14 extends from the sewn seam 20 so that the billowing corner 11 is held against the side of the mattress at a distance from the bottom end of the mattress. With this arrangement the billowing flap or corner 11 at each corner of the mattress extends from the end of the mattress to a position along the side edge of the mattress. This enables the billowing flap 11 to extend outwardly from the side edge of the mattress for a distance of about 11 to 12 inches and leave sufficient space above the mattress to enable a person to move his/her feet around freely.

The elastic material 14 is provided in a non-extended, or virtually non-extended, position when the top sheet 10 is installed on the mattress. This important feature of the present invention occurs by extension of the elastic material when the top sheet 10 is being inserted onto the mattress 12, but when the top sheet structure is at rest on the mattress, the tension on the elastic material is eliminated.

The construction of this top sheet or cover arrangement of the present invention is evident from the description of the structure. For example, the sheet material is folded over to create a new bottom end 18 of the top sheet structure with the previous bottom end 15 being parallel this new end. This leaves openings at each side of the sheet, which are subsequently sewn up to close the openings.

Thereafter, the strips of elastic material 14 are attached at each side of the bottom edge 15 by sewing the elastic from the side edges 17 of the sheet structure where the openings have been sewn together to a short distance along the edge 15. Such a short distance has been found to be preferably one-third of the distance along the bottom edge 15. This elastic material 14, as it is sewn along the edge 15, pulls the side edges 17 inwardly for a small distance, as may be seen in FIG. 3. The elastic material 14 is then left at rest in the structure without any tension when the top sheet has been installed on the mattress.

In operation and use of the arrangement of the present invention, the top sheet 10, being a bedcovering or similar structure, such as a cover, a blanket, a quilt or the like, is put onto a mattress having a bottom sheet already installed. This installation occurs by pulling or extending the elastic material 14 at each side to enclose the respective bottom corner of the mattress. Once the bottom of the mattress and the corners are covered the tension in the elastic material 14 is released and the top sheet 10 is installed onto the mattress 12 without tension. In this position, the billowing flaps or corners 11 are left to be extended outwardly and/or downwardly from the mattress corners. When a person sleeping on the mattress gets into the bed, his/her feet can extend under the top sheet to raise the portion formed by the billowing flaps. With such an arrangement there is no binding or holding of the feet by the top sheet fitted onto the mattress. Such person can move his/her feet around freely during sleep without any binding or pulling of the top sheet.

Certain modifications and improvements will occur to those skilled in the art upon a reading of the foregoing description. Such modifications and improvements, which are not shown for the sake of conciseness, are properly within the scope of the following claims.

What is claimed is:

1. A rectangular, fitted, fabric top sheet for use on a mattress having a given width, a given length, a given thickness, a lower end and lower corners, said sheet having a width greater than said given mattress width, parallel side edges and a bottom edge, said sheet including an upper portion with side edges and a lower portion with side edges folded beneath said upper portion, the side edges of said lower portion being non-elastically sewn to the side edges of the upper portion to form a pocket to receive the lower end of the mattress, the pocket including billowing flaps of fabric sized to accommodate a user's feet at each mattress lower corner, and the bottom edge of said sheet being elastically gathered to a width approximately equal to said given mattress width and being unstretched when said sheet is fitted onto said mattress.

2. The fitted top sheet of claim 1, wherein said sheet has a width approximately equal to said given mattress width, plus about twice said given mattress thickness.

3. The fitted top sheet of claim 1, wherein said sheet has a length approximately equal to said given mattress length, plus about twice said given mattress thickness.

4. The fitted top sheet of claim 1, wherein the lower portion of said sheet has a length approximately equal to twice said given mattress thickness.

5. The fitted top sheet of claim 1, wherein said bottom edge includes elastically gathered outer segments and a non-gathered center section.

6. The fitted top sheet of claim 5, wherein said elastically gathered outer segments each have a length approximately equal to one-third of a length of said bottom edge when gathered.

7. A rectangular, fitted, fabric top sheet for use on a mattress having a given width, a given length, a given thickness, a lower end and lower corners, said sheet having a width approximately equal to said given mattress width plus about twice said given mattress thickness, parallel side edges and a bottom edge, said sheet including a rectangular upper portion with side edges and a rectangular lower portion with side edges folded beneath said upper portion, the side edges of said lower portion being non-elastically sewn to the side edges of the upper portion to form a pocket to receive the lower end of the mattress, the pocket including billowing flaps of fabric sized to accommodate a user's feet at each mattress lower corner, and the bottom edge of said sheet being elastically gathered to a width approximately equal to said given mattress width and being unstretched when said sheet is fitted onto said mattress.

8. The fitted top sheet of claim 7, wherein said sheet has a length approximately equal to said given mattress length, plus about twice said given mattress thickness.

9. The fitted top sheet of claim 7, wherein the lower portion of said sheet has a length approximately equal to twice said given mattress thickness.

10. The fitted top sheet of claim 7, wherein said bottom edge includes elastically gathered outer segments and a non-gathered center section.

11. The fitted top sheet of claim 10, wherein said elastically gathered outer segments each have a length approximately equal to one-third of a length of said bottom edge when gathered.

12. A method of forming a rectangular, fitted, fabric top sheet adapted for use on a mattress having a given width, a given length, a given thickness, a lower end and lower corners comprising:

a) providing a flat, rectangular textile sheet having a width greater than said given mattress width, parallel side edges and a bottom edge;

b) folding said bottom edge of said sheet underneath said sheet to form a rectangular lower portion with side edges to underlie a rectangular upper portion with side edges;

c) non-elastically sewing the side edges of said lower portion to the side edges of the upper portion to form a pocket to receive the lower end of the mattress; and d) elastically gathering said bottom edge to a width approximately equal to said given mattress width to form billowing flaps of fabric sized to accommodate a user's feet and to allow the bottom edge to be unstretched when said sheet is fitted onto said mattress.

13. The method of claim 12, wherein said sheet has a width approximately equal to said given mattress width, plus about twice said given mattress thickness.

14. The method of claim 12, wherein said sheet has a length approximately equal to said given mattress length, plus about twice said given mattress thickness.

15. The method of claim 12, wherein the lower portion of said sheet has a length approximately equal to twice said given mattress thickness.

16. The method of claim 12, wherein said bottom edge includes outer segments and a center segment, and said sheet is elastically gathered only at said outer segments.

17. The method of claim 16, wherein outer segments have a stretched state approximately equal to one-third of a length of said bottom edge.

* * * * *